US008573265B1

(12) United States Patent
Manninen

(10) Patent No.: US 8,573,265 B1
(45) Date of Patent: Nov. 5, 2013

(54) METHOD AND DEVICE FOR USE WITH FLEXIBLE LINERS

(76) Inventor: John A Manninen, Paradise, CA (US)

( * ) Notice: Subject to any disclaimer, the term of this patent is extended or adjusted under 35 U.S.C. 154(b) by 791 days.

(21) Appl. No.: 12/658,682

(22) Filed: Feb. 12, 2010

Related U.S. Application Data

(60) Provisional application No. 61/207,714, filed on Feb. 13, 2009.

(51) Int. Cl.
*B65B 31/04* (2006.01)
*B65D 25/14* (2006.01)
*B65F 1/06* (2006.01)

(52) U.S. Cl.
CPC ..... *B65F 1/06* (2013.01); *B65F 2210/179* (2013.01)
USPC ..... 141/65; 220/495.04

(58) Field of Classification Search
CPC ..... B65F 2210/179; B65F 1/06; B65F 1/068
USPC ..... 220/495.04, 495.01; 141/7, 8, 59, 61, 141/65
See application file for complete search history.

(56) References Cited

U.S. PATENT DOCUMENTS

| | | | | |
|---|---|---|---|---|
| 4,294,379 | A | 10/1981 | Bard | |
| 4,335,769 | A | 6/1982 | McManus | |
| 4,890,760 | A | 1/1990 | Nicoll | |
| 5,143,242 | A | 9/1992 | Millasich | |
| 5,263,520 | A | 11/1993 | Arai | |
| 5,339,959 | A | 8/1994 | Cornwell | |
| 5,794,670 | A * | 8/1998 | LaFleur | 141/314 |
| 6,015,063 | A * | 1/2000 | Poliquin | 220/495.04 |
| 6,893,158 | B1 | 5/2005 | Tipp | |
| 7,273,155 | B1 | 9/2007 | Gray | |
| 7,434,594 | B1 * | 10/2008 | Robbins et al. | 137/223 |
| 7,578,024 | B2 * | 8/2009 | Hughes | 15/310 |
| 7,828,168 | B2 * | 11/2010 | Gagnebin | 220/495.04 |
| 2006/0138148 | A1 | 6/2006 | Mena | |
| 2006/0175336 | A1 | 8/2006 | Wang | |
| 2009/0095755 | A1 | 4/2009 | McCurry | |

OTHER PUBLICATIONS

"Suck-Bucket" at web site www.suckbucket.com.
"Space Bag" at web site www.spacebag.com.

* cited by examiner

*Primary Examiner* — Timothy L Maust
*Assistant Examiner* — Robert Bell, III

(57) ABSTRACT

A four part system aiding users of flexible liners in the following ways:

1) A perforated conduit on the interior of a receptacle connects to a one-way valve and mating assembly for a vacuum device which is used to suck air out to conform the liner to the receptacle. It can be used on a new receptacle designed for it, or retrofitted to most existing receptacles.
2) A tube which allows air to be removed from a filled liner by squeezing the bag or using the same vacuum device, making the liner smaller and easier to handle.
3) As a result of removing air from inside a filled liner, little or no vacuum is created when the liner is removed, making the process of separating the liner from the receptacle much easer for the user.
4) An adhesive device which is applied to the interior of a receptacle allows it to be emptied without the flexible liner falling out and yet allowing the liner to be easily removed for disposal.

2 Claims, 11 Drawing Sheets

METHOD AND DEVICE FOR USE WITH FLEXIBLE LINERS

CROSS-REFERENCE TO RELATED APPLICATIONS

This application claims the benefit of PPA U.S. Application No. 61/207,714, filed Feb. 13, 2009 by the present inventor.

BACKGROUND

1. Prior Art

The following is a four part tabulation of some prior art that presently appears relevant:

1. Air Trapped Between Receptacle and the Flexible Liner: U.S. patents

| Pat. No. | Kind Code | Issue Date | Patentee |
|---|---|---|---|
| 5,143,242 | A | Sep. 1, 1992 | Millasich |
| 5,375,732 | A | Dec. 27, 1994 | Bowers |
| 6,634,518 | B1 | Oct. 21, 2003 | Jones |
| 7,273,155 | B1 | Sep. 25, 2007 | Gray |

U.S. patent application Publications

| Publication Nr | Kind Code | Publ. Date | Applicant |
|---|---|---|---|
| 20040084456 | A1 | May 6, 2004 | Lubrano |
| 20060138148 | A1 | Jun. 29, 2006 | Mena |
| 20060175336 | A1 | Aug. 10, 2006 | Wang |

2. Air Trapped Inside Flexible liners: U.S. patents

| Pat. No. | Kind Code | Issue Date | Patentee |
|---|---|---|---|
| 5,263,520 | A | Nov. 23, 1993 | Arai |
| 5,339,959 | A | Aug. 23, 1994 | Cornwell |
| 6,045,264 | A | Apr. 4, 2000 | Miniea |
| 7,578,320 | B2 | Aug. 25, 2009 | Borchardt |

3. Air restricted from entering the void between the liner and the receptacle. U.S. patents

| Pat. No. | Kind Code | Issue Date | Patentee |
|---|---|---|---|
| 4,294,379 | | Oct. 13, 1981 | Bard |
| 4,890,760 | | Jan. 2, 1990 | Nicoll |
| 5,390,818 | A | Feb. 21, 1995 | LaBuda |

4. Liner Retainers: U.S. patents

| Pat. No. | Kind Code | Issue Date | Patentee |
|---|---|---|---|
| 4,335,769 | | Jun. 22, 1982 | McManus |
| 6,029,844 | A | Feb. 29, 2000 | Brady |
| 6,837,394 | B1 | Jan. 4, 2005 | Nnamani |
| 6,893,158 | B1 | May 17, 2005 | Tipp |

Non-patent Literature Documents - "Suck-Bucket" web site www.suckbucket.com

2. Field of Invention

This invention relates to the use of flexible liners, specifically air trapped between the receptacle and liner, air inside a full liner, air needed to fill a void to help remove a liner, and the purposeful adhesion of a liner to a receptacle.

3. Prior Art

Flexible plastic liners protect receptacles and provide an easy means of removing their contents. However, there are at least four problems in the use of these flexible liners. The first is when air is trapped between the receptacle and the liner, preventing the liner from conforming to the container. The second is when air is trapped inside a filled and closed flexible liner causing a billowing pillow effect. Third is when air is restricted from entering the void between a filled liner and the receptacle, creating a vacuum as it is removed. Fourth is when it is desirable to keep the flexible liner in place for repeated use, thereby saving on the cost of liners and having less impact on the environment and landfills.

1. Air Trapped Between the Receptacle and the Flexible Liner.

When a new flexible liner is installed inside a receptacle, air is often trapped between the receptacle and its liner. This is due to the airtight seal at the top of the receptacle. The result is a liner that has a greater chance to be torn or fall into the bottom of the receptacle when sharp or heavy objects are tossed in. In addition, when lightweight items like paper towels and tissues are the primary contents, for example in a bathroom, only a fraction of the receptacle's volume can be used, which in turn requires them to be replaced more often and the use of more liners than is necessary. Inventions like U.S. Pat. No. 7,273,155 to Gray (2007) and others attempt to solve this problem. Most suffer, however, from one or more of the following disadvantages:

(a) Require the purchase of a new receptacle. Existing receptacles are thereby made obsolete, incurring extra unnecessary expense and wasting natural resources.

(b) Location of the exhaust port. A large factor in the continued successful operation of these devices is dependent on the position of the vacuum device and/or the type and position of the connecting suction conduit. Waste receptacles are, by their very nature, in a very dirty environment. They may contain solids or liquids or both, all of which tend to gravitate to the bottom. Often a liner will tear. If the vacuum source is placed in or near the bottom of the receptacle, it will no doubt be subjected to debris and/or liquids getting into the mechanism which could render it inoperative.

(c) Heavier containers. Some have nearly double the weight and therefore twice the cost of materials with no additional room for trash. This also makes them harder to use and harder to store.

(d) It can be used on only one container. The vacuum source and other parts are integral to one container only. If the customer wants or needs more, he or she must purchase another complete unit.

(e) Only small receptacles will work. Because of the limitations listed above, kitchen containers and smaller are the only receptacles that are practical. A large trash can would weigh too much. In addition, other size receptacles require retooling and separate manufacturing.

(f) No valve to prevent reverse air flow. Some devices have an open aperture between the exterior of the receptacle and the flexible liner. Because flexible liners are so lightweight, air moving past the receptacle, as from a fan or wind if outdoors, will reinflate the liner. This also does not allow the liner to cling to the interior walls which will be demonstrated later to have a beneficial effect.

(g) The lack of an easy to use interface to attach the vacuum source for maximum suction delivered directly to the liner.

Advantages:

Accordingly several advantages of one or more aspects are as follows: to provide a suction conduit that can be used on new receptacles as well as retrofit to existing receptacles, that employ the principle of heavier than air separation to filter out liquids and debris from the vacuum source and other components, that weigh less and therefore make it easier to use and cost less to manufacture, that employ a detachable vacuum source that can be used on other receptacles without incurring unnecessary duplication of parts and cost for the customer, that are versatile so one model can be used on a wide variety of receptacles from large to small thereby saving on retooling, and lastly, with the use of a valve, we have the benefit of an airtight vacuum to aid in holding a liner in place.

2. Air Trapped Inside the Flexible Liner

When a flexible liner is closed for removal, excess air can become trapped, causing the liner to be larger than necessary. This problem sometimes occurs because of the coarseness of the contents, haste in removal, and/or the difficulty in compressing the contents. Today, almost all residential and commercial waste collection is based on volume, not weight. The larger the volume the more one pays. Also, in some situations a smaller size is very advantageous. For example, residents of high rise apartment buildings who use garbage chutes may find that large bags may become stuck, leaving the chutes inoperable.

Large facilities, like hospitals or schools, collect filled liners from individual garbage cans and deposit them into transport carts with a finite amount of space. If the bags are smaller, more can be carried in one trip to the main collection location, saving on labor costs. A hospital's biohazard liners, as well as others, are sometimes punctured to allow excess air to escape. This could lead to contamination of the area, puncturing tool, and personnel.

Most prior art like Miniea U.S. Pat. No. 6,045,264 and Cornwell U.S. Pat. No. 5,339,959, use plastic bags with special valves or heat sealing methods to evacuate air from inside. From a cost and complexity standpoint, this would be very disadvantageous to consumers. Also, due to market saturation, introducing a new liner that would compete successfully with the large number already well established would be very hard to do.

Arai, in U.S. Pat. No. 5,263,520 has nondisposable parts inserted into the contents of a liner which when removed from the container will be soiled, thus spreading germs and other contaminates and requiring the equipment to be cleaned after every use. Also claimed is an inner tube in which debris sucked into the nozzle can become lodged, making it difficult to clean and more expensive to manufacture. Further adding to the problem is the inability to instantly cut off the reverse air flow once the vacuum source has been removed. It requires the user to remove a 40 to 60 cm long nozzle before a seal can be applied to the liner.

Advantages:

Accordingly, several advantages of one or more aspects are as follows: to use regular consumer bags without special valves or seals, to make them smaller in size which makes it easier to get a better grip on the bag, to provide a disposable air release straw for a sanitary means of air removal so one need not touch or clean the device and debris and germs are not exposed when the device is removed, and to provide a more compact bag that uses less space which could result in labor and disposal savings.

3. Air Restricted from Entering the Void Between the Liner and the Receptacle.

When a flexible liner is filled, its contents press outward on the receptacle. This force, combined with the sealing effect of the liner, prevents air from entering the space immediately below the departing flexible liner. This makes removal of the liner difficult and awkward. Several patents like Bard U.S. Pat. No. 4,294,379 use upward vented conduits to provide air to fill the void. Because of the amount of replacement air instantaneously required, these conduits and their cross-sectional area have a difficult time fulfilling that demand. Other art like Nicoll U.S. Pat. No. 4,890,760 and LaBuda U.S. Pat. No. 5,390,818, require the purchase of a new receptacle with a vent located in the bottom of the receptacle. As mentioned before, reliable operation would be difficult due to its location and environment. A sticky substance or fluid could prevent it from working or could leak out.

All of these methods and devices will now be shown as unnecessary. Since air comprises a large percentage of the interior volume of a filled flexible liner, it can be demonstrated that if a vacuum were to be applied to the interior of a filled flexible liner, its diameter would shrink significantly. Copious amounts of air would then pass by the liner, allowing it to be easily removed.

Advantages:

It follows that by the use of an air release straw to compact a liner, the user gets the same results without the purchase of a special container, or the use of conduits, valves or devices on the inside of a container, it requires no installation, and can be used on almost any receptacle that uses a flexible liner, regardless of shape or size.

4. A Method of Retaining a Flexible Liner for Repeated Use.

Under some circumstances, it is desirable to have a flexible liner in place but not remove it when the contents are emptied. Recycling bins are one such application. Normally their contents are clean. However, some residual fluids or other debris may leak out and contaminate the receptacle. If a flexible liner is not used, the owner is then faced with a much larger task of cleaning the receptacle. Some government agencies are faced with a similar dilemma. Most states and the Federal government have policies which recommend whenever possible the reuse of items, including the elimination of unnecessary can liners by using smaller containers which are emptied daily into a central trash container. While this saves on the cost of liners and helps the environment, it costs much more in labor to clean a waste container if something inappropriate were to be placed in it. A simple solution is reusing one flexible liner over and over. This is facilitated through the use of a simple adhesive strip on the interior of the receptacle to hold the flexible liner in place when the receptacle is inverted to empty its contents and the use of the vacuum source to reacquire a tight fit on the existing liner.

McManus U.S. Pat. No. 4,335,769 shows a container entirely supported by adhesive strips, which do not aid in holding a flexible liner. Whereas Tipp U.S. Pat. No. 6,893,158 is an adhesive liner retainer device, but it functions by pulling the liner tight around the top on the exterior of the receptacle. Brady U.S. Pat. No. 6,029,844 is a flexible liner with a built-in adhesive strip near the top of the liner. As with Tipp U.S. Pat. No. 6,893,158, the adhesive strip near the top and located on the exterior when installed in a receptacle is there to prevent the liner from falling into the container. They would do little to aid in keeping the liner inside the container once it is inverted.

Advantages:

Subsequently it can be shown what the improvements are: it is simple to use, it is positioned to hold the bottom of the liner, it will not tear the liner, it can be used over and over, and by using fewer liners, it saves money and is an environmental benefit to everyone.

SUMMARY

The present invention may have one or more of the following advantages. It helps the user install a flexible liner tight against the interior surfaces of the waste receptacle. Only one vacuum source is needed. For additional waste receptacles, the owner need only purchase the inexpensive suction conduits. With the use of an optional disposable air release straw, the interior of a filled liner can have excess air removed making it smaller and more compact for easier disposal.

When the air release straw is used on a filled liner still inside a receptacle, the liner's diameter shrinks dramatically. This allows air to easily flow past and makes removing the liner from the receptacle very easy. And lastly, for those who wish to reuse their flexible liners to save on costs and help the environment, a system using a special adhesive positioned on the interior of the receptacle can be used to hold the liner in place when the contents are emptied. It will allow the user to remove a liner when necessary without tearing it, and the adhesive can be used again and again.

DRAWING

Figures

FIG. 1 is a perspective view of a waste receptacle 20, with the motor and battery assembly 80, providing power for the vacuum impeller assembly 84, which is interfaced with the front valve cover 30.

FIG. 2 is a perspective view of waste receptacle 20 and suction conduit screen 40. For clarity, a flexible liner 10 is not shown.

REFERENCE NUMERALS

Figure 1:
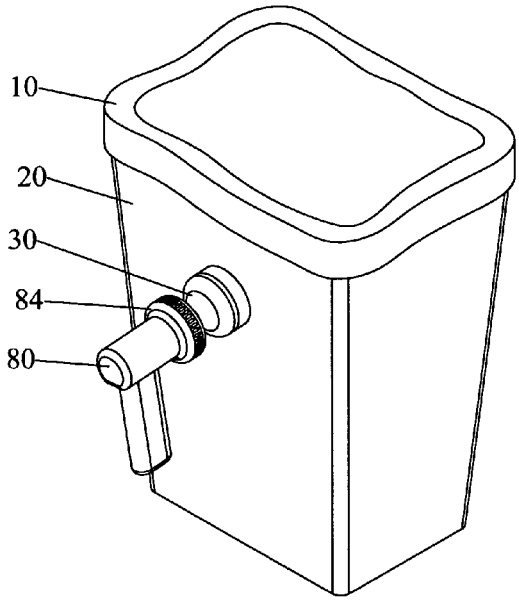

10 flexible liner
20 waste receptacle
30 front valve cover
32 valve
34 spring
36 valve guide
38 rear valve cover
40 suction conduit screen
42 suction conduit base
50 strainer
51 penetrating strainer
52 filter
54 mid-section tube
55 seal
56 valve holder
57 crush valve
58 one-way valve
59 upper tube inside fit
60 upper tube
70 low tack adhesive
72 substrate
74 high tack adhesive
80 motor and battery assembly
82 drill assembly
84 vacuum impeller assembly

DETAILED DESCRIPTION

Air Trapped Between the Receptacle and the Flexible Liner

Figure 2:
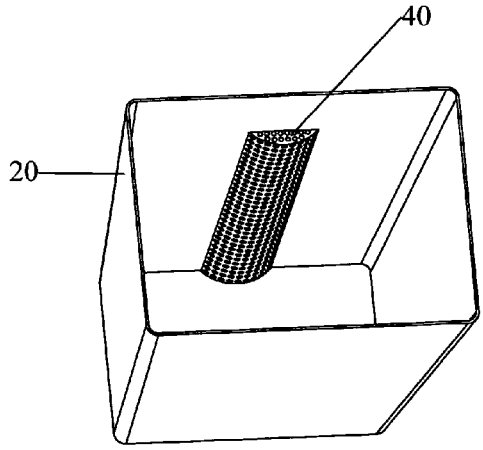
Figure 3:
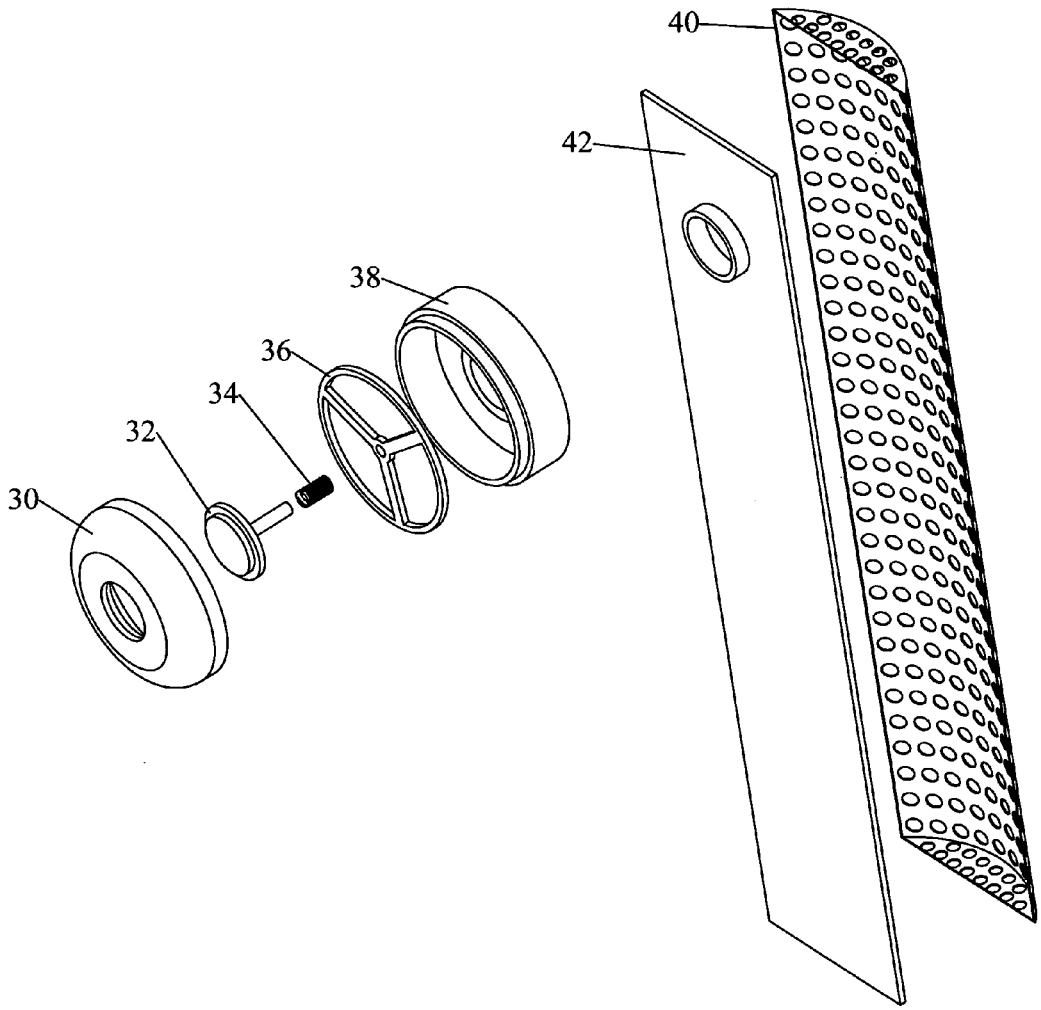
FIG. 3 is an exploded view of and will collectively be referred to henceforth as the suction conduit assembly.

My invention aids the user of flexible liners in several ways. First, when the suction conduit assembly (FIG. 3) is installed on the waste receptacle 20, as in FIG. 1 and FIG. 2, air trapped between the liner 10 and the waste receptacle 20 can be vacuumed out. As depicted in FIG. 1, a vacuum source (FIG. 4) is attached to the suction conduit assembly. It depresses spring 34 and opens valve 32. Air flows from the void between the flexible liner and the receptacle, first through the suction conduit screen 40, then through an aperture in the suction conduit base 42. It then travels through the valve assembly comprising the rear valve cover 38, valve guide 36, spring 34, valve 32, and finally through front valve cover 30. The vacuum source directly engages the aperture in the front valve cover 30 to facilitate an airtight connection. The aforementioned valve performs other functions. First, it prevents air from reentering the void. Without this valve, liners have a tendency to billow back to an undesirable shape. This is especially true if the waste receptacle is outdoors. Wind applies sufficient atmospheric pressure through the vent hole as to compress the easily moved flexible liner. Second, when it is desirable to reuse a flexible liner, it maintains a vacuum which helps hold the liner in place when the waste receptacle is inverted to empty its contents.

Screen 40 helps filter out large debris and keeps the flexible liner away from the air channel. It also performs as a heavier than air particle and fluid separator. Because of the numerous apertures in its front cover, air is conveyed through its center channel leaving behind anything that is heavier than air. It may be so constructed as to be easily removed to facilitate cleaning.

Figure 5:
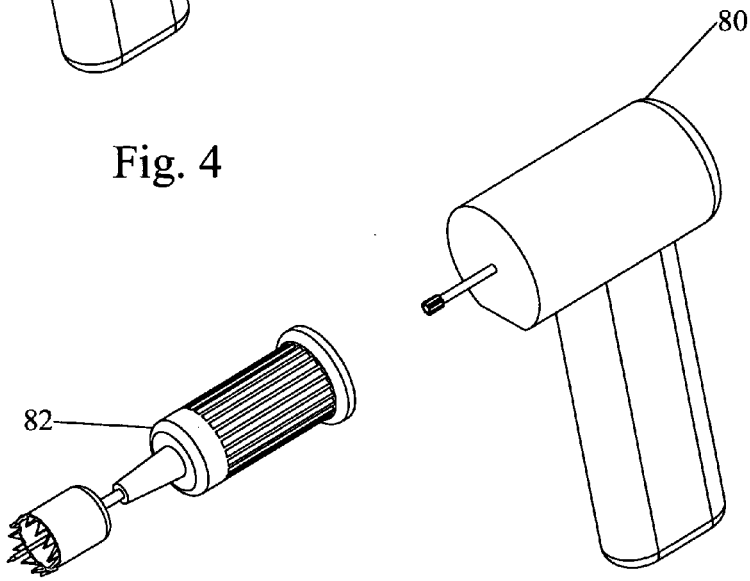
FIG. 5 is an exploded view of the motor and battery assembly 80 and the drill assembly 82.

Because of the environment in which this invention is used, a solid mounting location is difficult to maintain. The suction conduit is mounted to an existing waste receptacle, in an upright position, through an aperture in the side of the waste receptacle provided by the customer or manufactured into a new container. This aperture can be made with the drill assembly 82, as shown in FIG. 5, which is temporally attached to the motor and battery assembly 80. The aperture will provide a firm location to mount the suction conduit. To facilitate manufacturing, valve 32 can be replaced with another type, but not limited to, such as a flapper or a flexible mushroom valve.

Air Trapped Inside the Flexible Liner.

Figure 6:
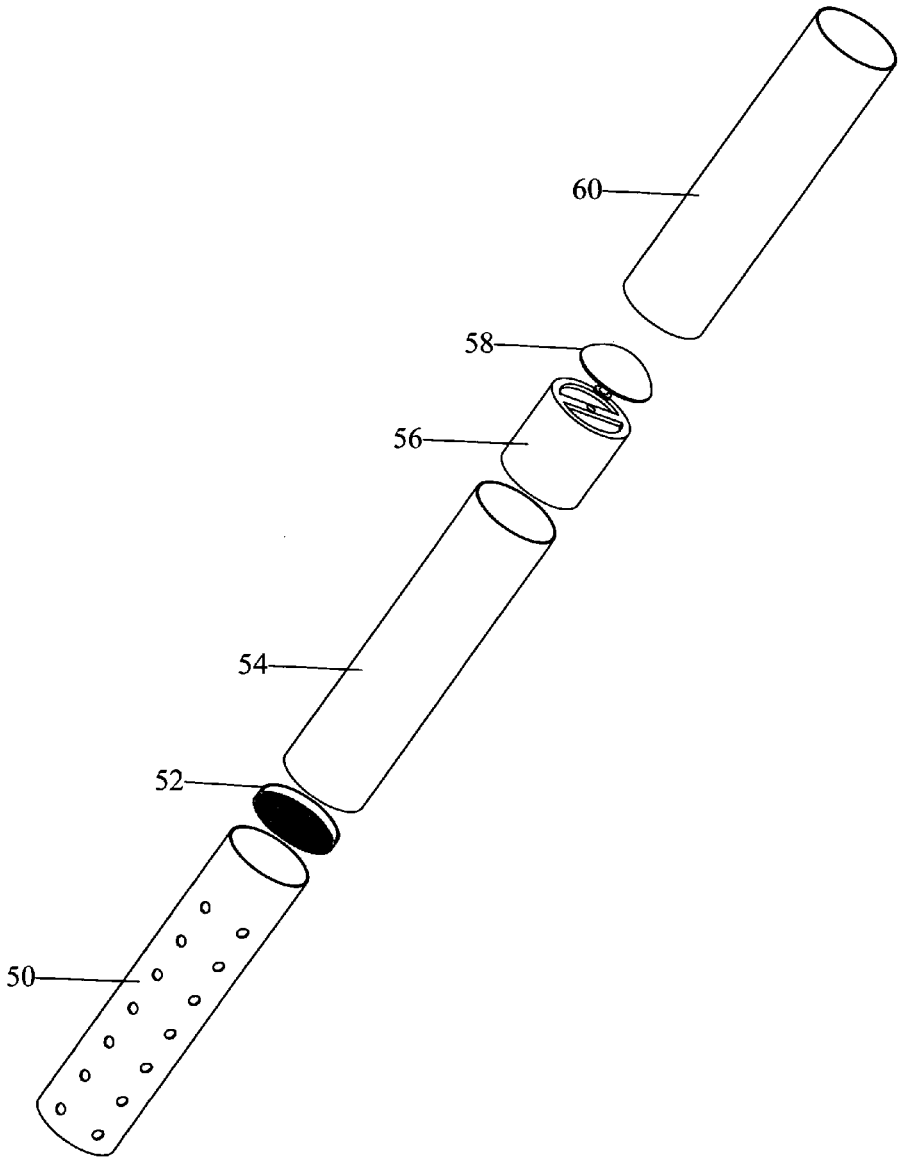
FIG. 6 is an exploded view of one embodiment and will collectively be referred to henceforth as the air release straw.
Figure 7:
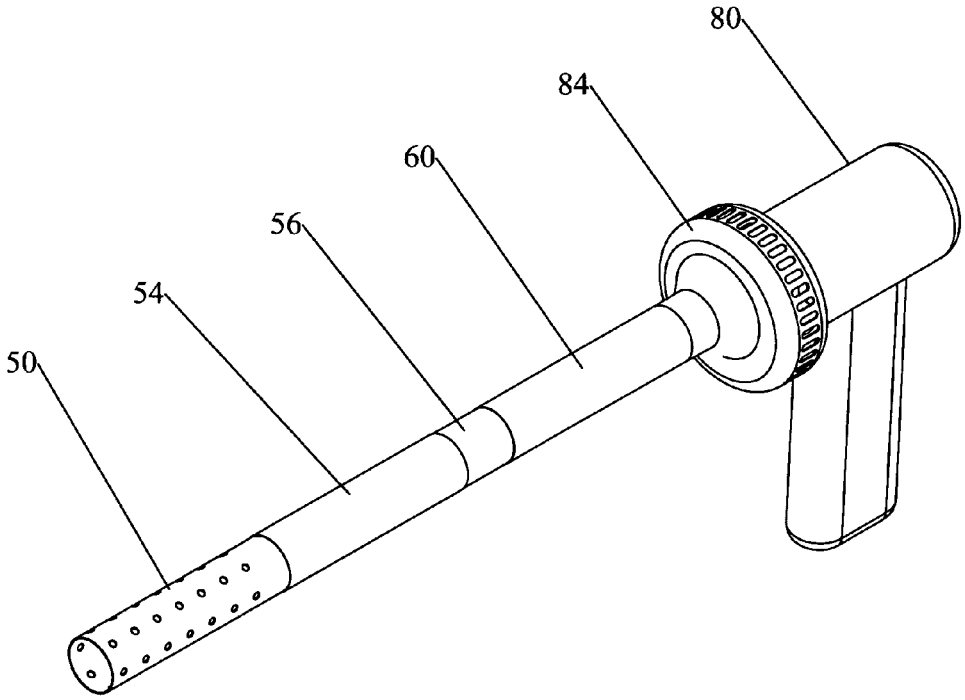
FIG. 7 shows the air release straw attached to the vacuum source.
Figure 8:
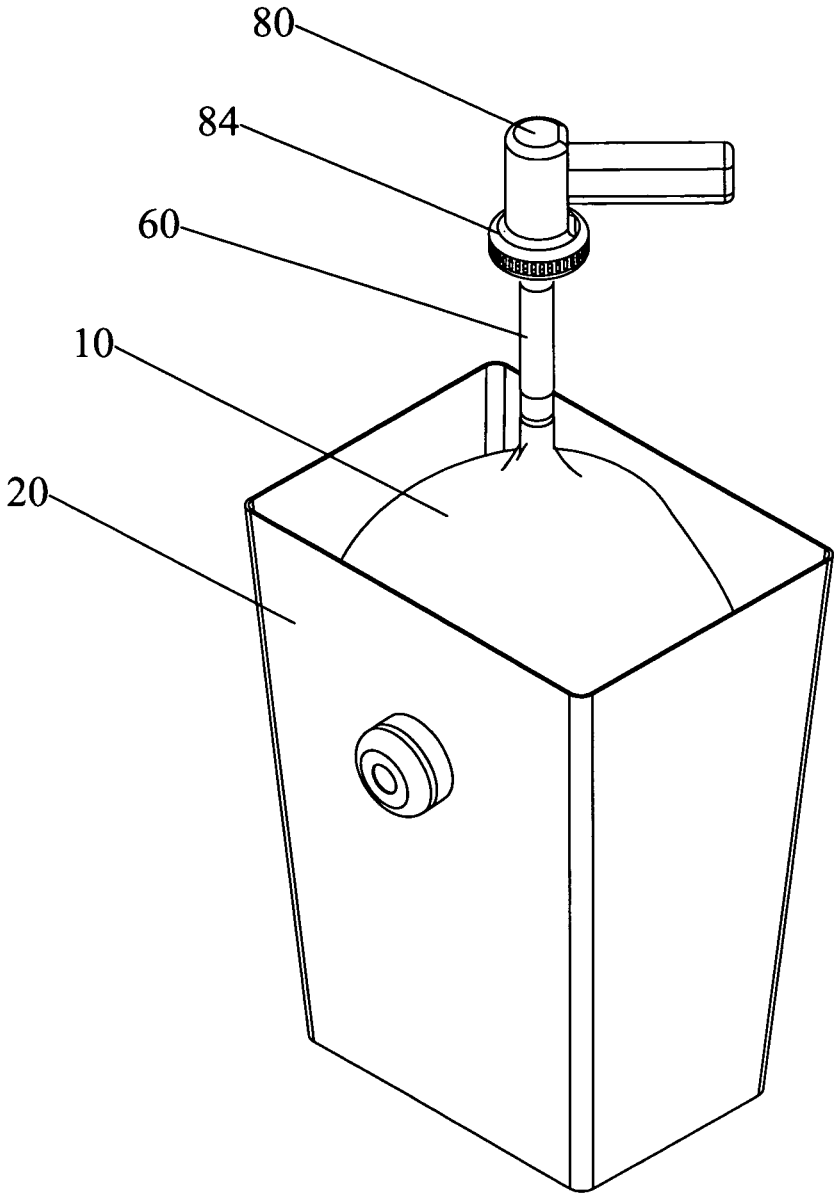
FIG. 8 is a view of the vacuum device removing air from a flexible liner inside a receptacle through a air release straw.
Figure 9:
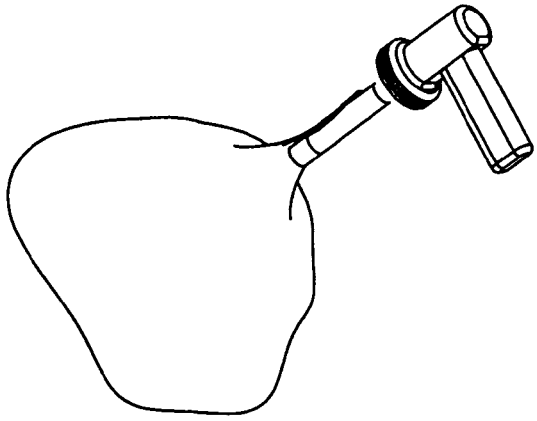
FIG. 9 shows the vacuum device used on a flexible liner outside a receptacle.

One embodiment of an air release straw as shown in FIG. 6 is used to remove air from the interior of a filled flexible liner and may have one or more of the following advantages. It can be attached to the vacuum source, as depicted in FIG. 7, to quickly and efficiently remove excess air (FIGS. 8 & 9). Or used alone, FIG. 10, one can depress the liner and manually expel excess trapped air. FIG. 6 shows one possible configuration of an air release straw, all or parts of which could be constructed of inexpensive disposable material like cardboard or plastic. Air first enters through strainer 50 which helps prevent the contents or the liner from obstructing the air channel. Here again the operating principle is that, with open communication all around the straw, fluids and debris would have a difficult time reaching the vacuum source. Additionally a simple screen might be employed in the air channel, like filter 52. It may be constructed of an inexpensive material. In one embodiment, cheesecloth or cotton would be used. However, in some environments, like biohazardous wastes, it may be desirable to use a higher grade filter. A back up filter may be installed on the vacuum source itself which, if used in conjunction with a detachable vacuum impeller assembly 84, can be easily cleaned. Additionally, a scented or unscented air freshener might be combined with filter 52 or attached to the vacuum source which could be used separately as a stand alone air freshener.

The mid-section tube 54 is a transitional tube used to connect and/or contain the filter 52, and in some instances the one-way valve and holder 58 & 56, or manual crush valve 57. Additionally, mid-section tube 54's exterior may be coated with an adhesive, the purpose of which is to bind and close the top of the flexible liner. When the air release straw assembly is inserted into a flexible liner, the upper edges can be attached to mid-section tube 54. With the addition of a mechanical fastener around the exterior, such as a small amount of masking tape or a twist tie, an airtight seal can be obtained.

Valve holder 56 provides a seat for one-way valve 58 and may provide a connection point for mid-section tube 54 and upper tube inside mount 59 or upper tube 60. However valve holder 56 and one-way valve 58 may be positioned inside parts 54, 59, or 60. The purpose of one-way valve 58 is to permit air to exit the liner during evacuation and/or expulsion, and, once completed, to instantaneously prevent air from reentering. One-way valve 58 is depicted as a mushroom valve, but depending on commercial viability, may be replaced with another, but not limited to, a flapper valve or pinch valve.

An alternate version (FIG. 11) of a air release straw would not use valve holder 56 and one-way valve 58. In the same location, a single use crush valve 57 would be employed. It would be constructed with, but is not limited to, an adhesive surface with a compressible substrate located circumferentially on the interior portion of said tube. Crush valve 57 may be designed to be a separate component or formed integrally, and may be contained inside mid-section tube 54, upper tube 60, or upper tube inside fit 59. After the air had been expelled or evacuated from the liner, the user would then crush the portion of the tube containing the valve, thereby sealing the airway.

Upper tube 60 is connected to valve holder 56, and completes the air channel. After the air release straw has been inserted and sealed to the flexible liner, upper tube 60 is left exposed. Upper tube 60 is the point to which the vacuum source 84 is interfaced (FIG. 7). Ample distance is provided to prevent the tip of the vacuum source from coming in contact with the one-way valve 58 or valve holder 56 or, in the case of a manual crush valve 57, the internal adhesive surface with a compressible substrate. If upper tube inside fit 59 is used, vacuum source 84 will not contact crush valve 57; however the valve should be positioned away from the vacuum source 84 interface to provide ample room to facilitate proper operation. Additionally, upper tubes 59 and 60 and may include a handle on some embodiments to provide a handgrip.

Figure 12:
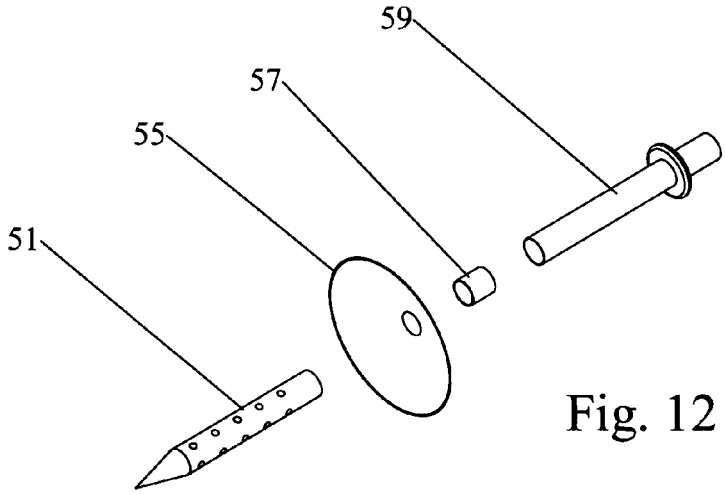
FIG. 12 is a exploded view of a second embodiment and will collectively be referred to henceforth as the penetrating air release straw.
Figure 13:
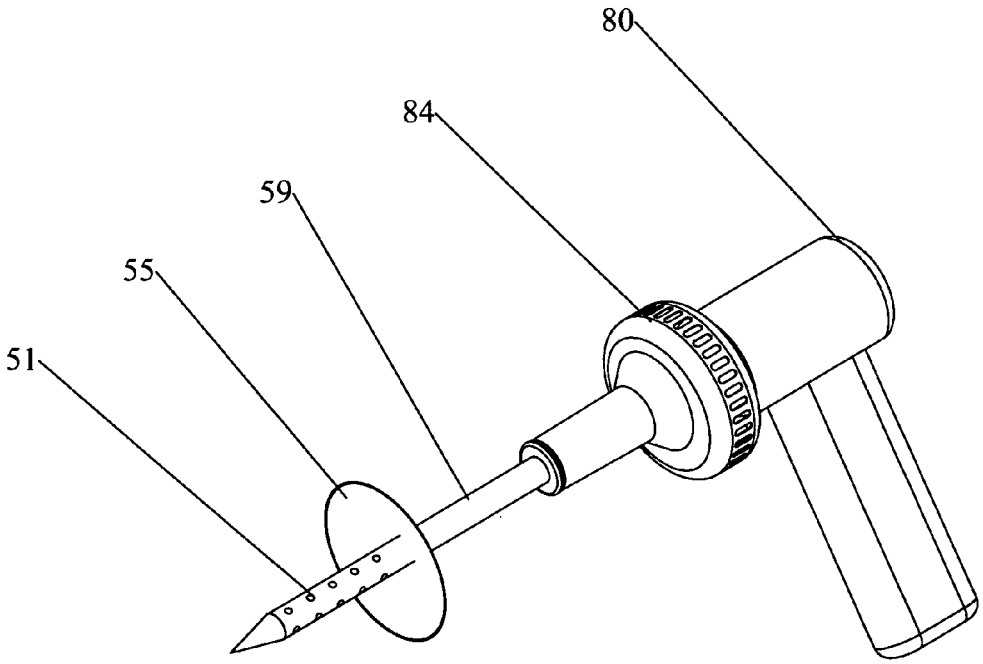
FIG. 13 shows the penetrating air release straw attached to the vacuum source.
Figure 14:
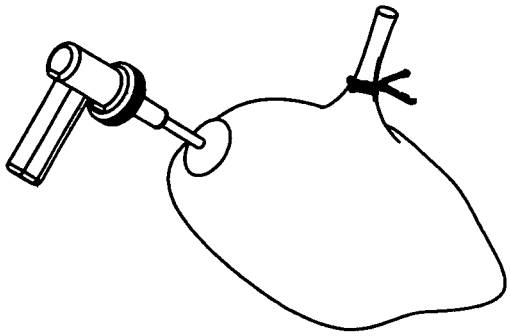
FIG. 14 is the penetrating air release straw and vacuum source removing air from a liner.
Figure 15:
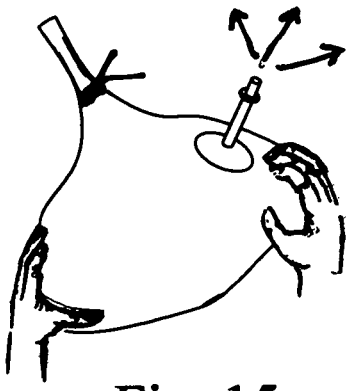
FIG. 15 shows the manual method of removing air from inside a flexible liner using the penetrating air release straw.
Figure 16:
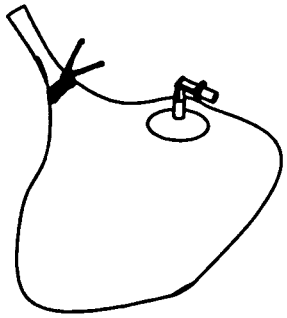
FIG. 16 shows a penetrating air release straw with a manual valve after crimping.

In another embodiment a penetrating strainer 51, seal 55, crush valve 57, and upper tube 59 are combined in FIGS. 12 and 13 to form an air release straw whose function is to puncture a filled and closed flexible liner and evacuate or expel the air contained therein. Strainer 51 is designed to form a sharp point on one end to facilitate an easy puncture of flexible liner. Seal 55 has a conical shape with the concave side covered in an adhesive to form an airtight connection with the liner.

All of the aforementioned components of a air release straw are depicted as individual parts. However, it might be possible to manufacture most in a single process. Therefore, there would be no delineation between boundaries, say for example, between the strainer 50 and the mid-section tube 54 or upper tube 60. Further, features and functions of one embodiment might be used in place on other embodiments. Although the description above contains many specificities, these should not be construed as limiting the scope of the embodiments but as merely providing illustration of some of several embodiments.

A Method of Retaining a Flexible Liner for Repeated Use.

Figure 17:
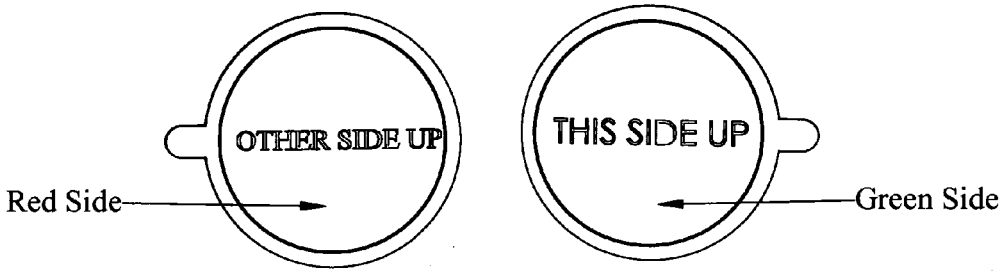
FIG. 17 shows a front and a rear view of a liner retainer adhesive strip.
Figure 19:
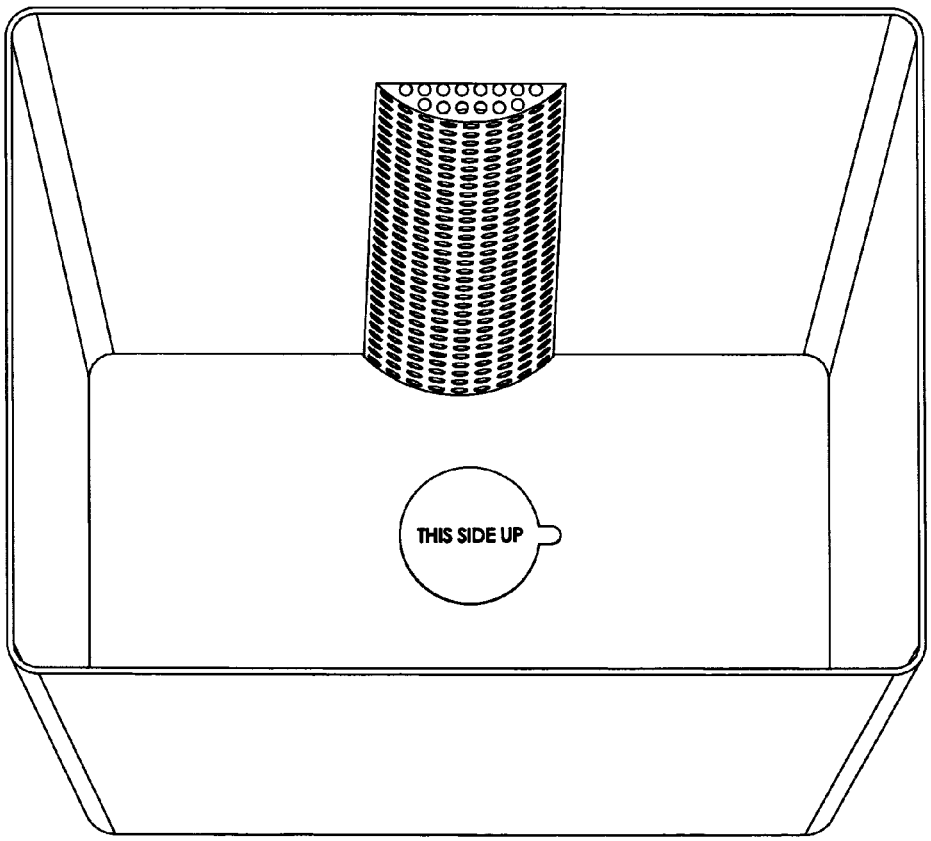
FIG. 19 is a view of the liner retainer installed in a waste receptacle.

FIG. 17 shows both operating sides of an adhesive liner retainer. It is used to hold a liner in place when the waste container is inverted to empty its contents. Typically the liner retainer would be positioned in the lower portion or bottom of a waste receptacle as shown in FIG. 19. To identify the two different sides, they may be colored so that the green side with the text "THIS SIDE UP" printed on it would be the side to be in direct contact with the flexible liner and has a low tack adhesive coating. This allows good adherence to the flexible liner, but will permit it to be detached without tearing it. The red side, with the text "OTHER SIDE UP" printed on it, would be in contact with the waste receptacle and has high tack adhesive coating. This assures the adhesive liner retainer will remain attached to the waste container during emptying or liner replacement. During operation, the adhesive liner retainer is covered and protected by the liner itself and should therefore last for repeated uses.

Figure 18:
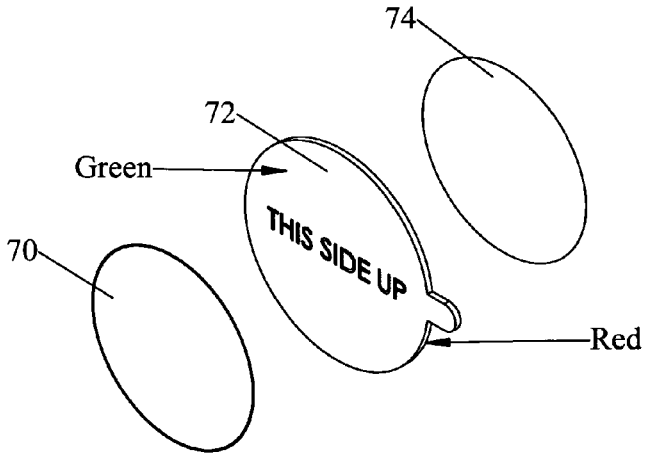
FIG. 18 is an exploded view of a liner retainer adhesive strip.

FIG. 18 shows an exploded view of the construction of the adhesive liner retainer. Low tack adhesive 70 and high tack adhesive 74 are permanently attached during manufacturing to substrate 72. This might be accomplished using a coarse substrate. Alternatively, perforations in the substrate, during the molten state, may allow the adhesives to directly bond to each other.

In addition to the above, this adhesive strip might have other uses, for example a refrigerator picture holder (a magnet covers over and hides some of the picture). An adhesive strip with a low tack side facing outward would also provide an easy and safe way to temporarily display objects. It would be especially useful in holding objects of irregular shape that cannot be held by a magnet or on a nonferrous surfaces. Other uses might include signs that are changed often, like a restaurant's "Special of the Day" sign.

Installation and Operation of the Suction Conduit.

The user installs the suction conduit by drilling a hole at a predetermined height from the bottom in a waste receptacle using a commercially available drill and bit or by using a starter kit which may include a drill attachment as shown in FIG. 5. A suction conduit is then attached to the hole, with the suction conduit screen 40 and suction conduit base 42 located on the interior of the waste receptacle. Through the above-mentioned hole, the suction conduit base 42 will attach to a valve assembly on the exterior and will firmly hold both in place. This completes the installation phase.

Figure 4:
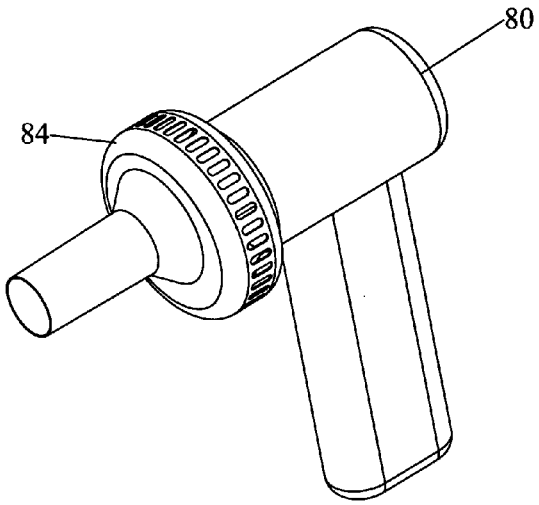
FIG. 4 shows the motor and battery assembly 80, attached to the vacuum impeller assembly 84, and will collectively be referred to henceforth as the vacuum source.

Operation is as follows: a new flexible liner is installed in the waste receptacle in the usual manner, paying close attention to obtain a good seal of the liner to the top of the receptacle. The vacuum source, as depicted in FIG. 4, is attached to the aperture in the valve assembly front valve cover 30 as shown in FIG. 1. The vacuum source then removes all the air from the region between the liner and the waste receptacle, thus stretching the liner tight against the interior of the receptacle.

Installation and Operation of the Air Release Straw.

Figure 10:
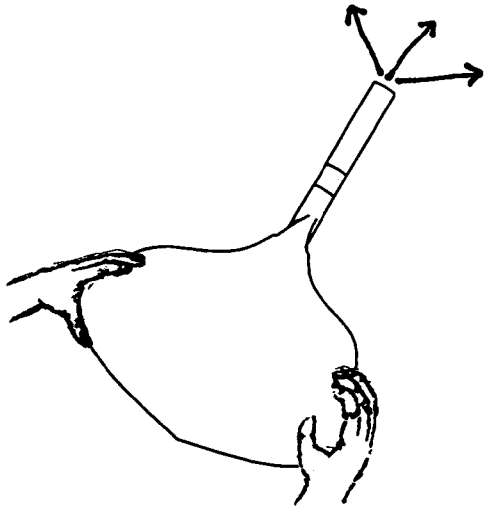
FIG. 10 shows the manual method of removing air from inside a flexible liner.
Figure 11:
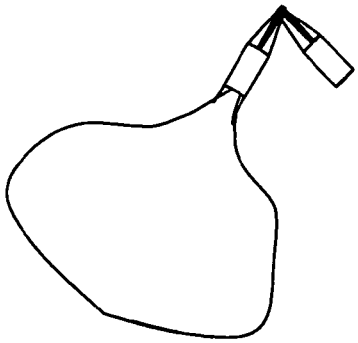
FIG. 11 shows an air release straw with a manual valve after crimping.

When the liner is to be replaced, an air release straw will have its protective cover over the external adhesive removed, then the straw is inserted into the top of the open liner with the strainer end inside the liner. One at a time, the sides of the liner will be attached to the external adhesive on the mid-section tube (54) of the air release straw. A short length of tape or a twist tie will complete the seal of the liner to the air release straw. The vacuum source is attached to the exposed end of the air release straw as depicted in FIGS. 8 & 9 and air is removed from the interior of the liner. If a manual valve is used inside the air release straw, the straw can now be crushed or folded over closing off the air flow, as shown in FIG. 11. If the air in the liner is to be manually expelled, the air release straw is inserted and attached as above. Then, in place of the vacuum source, one simply applies pressure to the outside of the bag to force out the air as shown in FIG. 10.

In another embodiment the user first seals the opening in the filled flexible liner using the conventional methods; for example, tying the end in a knot, or rotating the liner about itself and attaching a twist tie, or by any other method that produces a reasonably good airtight seal. Then an air release straw with a penetrating strainer (51) and seal (55) are used to penetrate the filled flexible liner on the upper side. The upper side is used because it will produce the best results without engaging excess amounts of liquids and debris that might be present at or near the bottom. Furthermore it is the only side exposed if this process is to take place with the liner still in the receptacle. Next one will attach the vacuum source to remove the air from the liner, or push on the exterior of the liner if the manual method is used. If valve (58) is used, air is prevented from reentering the liner and the process is complete. If a manual crush valve (57) is used, the user will simply crush or fold in two the section of the air release straw that contains the crush valve (57) or interior adhesive coating.

Installation and Operation to Allow Air to Fill the Void.

This action is a byproduct of the use of the air release straw or the penetrating air release straw. Both of these methods, if used with a filled flexible liner still inside the receptacle, will compact the liner and shrink its diameter which will allow large amounts of air to flow past the liner to fill the vacuum caused by the departing liner.

A Method of Retaining a Flexible Liner for Repeated Use.

If one wishes to reuse the flexible liner, an adhesive liner retainer can be installed before a new liner is put in place. One would simply remove the protective covers over both sides of the liner retainer and place in the bottom or sides of the waste receptacle with the green side up. One then installs the new liner as described above using the vacuum source to pull the liner tight, placing it in contact with the liner retainer. When the waste receptacle is full, the contents can be emptied into a larger container. One can then, as needed, use the vacuum source to touch up the liner.

I claim:

1. A device for removing air from the region between a receptacle and a flexible liner installed therein comprising:

a vacuum source;

an aperture in a side wall of said receptacle, provided by the user or manufactured into a new receptacle, at a predetermined distance above a bottom surface of said receptacle; and an air conductor from said region to said vacuum source, the air conductor comprising:

an elongated suction conduit screen having an arch shaped cross section and a front arch shaped elongated surface having a plurality of holes extending over a majority of said surface and engaging with a back elongated suction conduit base having a flat cross section;

wherein said back elongated suction conduit base together with said suction conduit screen form an air channel on the interior of said receptacle;

wherein said air channel has a distal end proximate to the bottom of said receptacle and converging upward;

wherein said suction conduit base contains a raised aperture protruding outward at a predetermined distance above the distal end;

wherein said suction conduit base is positioned such that said raised aperture is concentric with and transverse through said aperture in said side wall of said receptacle;

wherein said raised aperture includes a proximal end having an imbricated connection to mate with said vacuum source whereby said vacuum source completes fluid communication from said vacuum source to said region between a receptacle and a flexible liner through the interior of said raised aperture, through said suction conduit base, and through said plurality of holes in said front arch shaped elongated surface;

wherein the air conductor comprises a valve assembly comprising a rear valve cover, a valve guide, a spring, a valve, and a front valve cover; and wherein the vacuum source is attached to said air channel on the interior of said receptacle through a suction conduit screen.

2. The device of claim 1, wherein the valve assembly is on the exterior of said receptacle;

wherein the air conductor has a proximal end near the valve assembly and a distal end away from the valve assembly;

wherein said proximal end of the air conductor is concentrically attached to said raised aperture on said suction conduit base; and wherein said distal end of the air conductor has an imbricated connection to mate with said vacuum source whereby said vacuum source engages and opens said valve assembly to complete fluid communication from the vacuum source to said region between a receptacle and a flexible liner through the interior of said valve assembly, through said raised aperture in said suction conduit base, and through said plurality of holes in said front arch shaped elongated surface.

* * * * *